166-308 SR

8/4/87 XR 4,683,943

United States Patent [19]

Hill et al.

[11] Patent Number: 4,683,943

[45] Date of Patent: Aug. 4, 1987

[54] WELL TREATING SYSTEM FOR STIMULATING RECOVERY OF FLUIDS

[75] Inventors: Gilman A. Hill, Englewood; Richard S. Passamaneck, Littleton; Kenell J. Touryan, Indian Hills, all of Colo.

[73] Assignee: Mt. Moriah Trust, Englewood, Colo.

[21] Appl. No.: 890,077

[22] Filed: Jul. 24, 1986

Related U.S. Application Data

[62] Division of Ser. No. 686,990, Dec. 27, 1984, Pat. No. 4,633,951.

[51] Int. Cl.[4] ..... E21B 29/02; E21B 43/11

[52] U.S. Cl. ..... 166/63; 166/177; 166/299; 166/308

[58] Field of Search ..... 166/63, 299, 177, 250, 166/55.1, 55, 297; 175/4.6, 2

[56] References Cited

U.S. PATENT DOCUMENTS

| | | | |
|---|---|---|---|
| 3,001,584 | 9/1961 | Scott | 166/63 |
| 3,002,559 | 10/1961 | Hanes | 166/63 |
| 3,064,733 | 11/1962 | Bourne, Jr. | 166/63 X |
| 3,101,115 | 8/1963 | Riordan et al. | 166/67 X |
| 3,313,234 | 4/1967 | Mohaupt | 166/63 X |
| 4,039,030 | 8/1977 | Godfrey et al. | 166/63 X |
| 4,329,925 | 5/1982 | Hane et al. | 166/63 X |
| 4,391,337 | 7/1983 | Ford et al. | 166/299 |

*Primary Examiner*—Stephen J. Novosad

*Attorney, Agent, or Firm*—Hubbard, Thurman, Turner & Tucker

[57] ABSTRACT

Subterranean oil and gas producing formations are fractured by providing one or more combustion gas generating units using rocket fuel type propellants disposed in a well casing at preselected depths. The well casing is filled with a compressible hydraulic fracturing fluid comprising a mixture of liquid, compressed gas, and propant material and precompressed to a pressure of about 1,000 psi or more greater than the fracture extension pressure at the depth of the zone to be fractured. At least one of the gas generating units is equipped with perforating shaped charges to form fluid exit perforations at the selected depth of the fracture zone. The gas generating units are simultaneously ignited to generate combustion gasses and perforate the well casing. The perforated zone is fractured by the rapid outflow of an initial charge of sand free combustion gas at the compression pressure followed by a charge of fracturing fluid laden with propant material and then a second charge of combustion gas. The column of precompressed fracturing fluid is discharged into the formation until the hydraulic extension pressure is reached and eventually the perforations sanded off.

3 Claims, 6 Drawing Figures

WELL TREATING SYSTEM FOR STIMULATING RECOVERY OF FLUIDS

This is a Division of application U.S. Ser. No. 686,990 filed Dec. 27, 1984 now U.S. Pat. No. 4,633,951

BACKGROUND OF THE INVENTION

1. Field of the Invention

The present invention pertains to a method and system for fracturing a subterranean rock formation to stimulate the recovery of oil, gas and other fluids by producing fractures in the formation utilizing a downhole combustion gas generator and the decompression of a propant laden, compressible fracturing fluid.

2. Background

In the art of treating subterranean formations to stimulate the recovery of fluids such as crude oil and gas, hydraulic fracturing of one or more fluid rich zones is widely practiced. Conventional hydraulic fracturing techniques suffer from several disadvantages, depending on the characteristics of the rock formation. In almost all cases the development of the fracture and the ultimate yield of fluids from the formation as a result of the fracture is limited by the inability to pump fluids down the wellbore and out through perforations in the well casing at a rate sufficient to overcome pipe friction losses and leak off of the fracturing fluid into the formation itself. Typically, the fracturing fluid pumping rate in many applications may not be sufficient to initiate and maintain a fracture long enough to accept a sufficient amount of propant carried in the fracturing fluid to open the fractures wide enough so as to produce satisfactory yields of well fluids.

In order to overcome the disadvantages and limitations of conventional surface pumping of subterranean formation fracturing fluids it has been proposed to place devices in the wellbore at various depths which will generate sufficient energy to propel a quantity of fracturing fluid into the formation. For example, U.S. Pat. No. 3,101,115 to M. B. Riordan, Jr. describes a well treating method and apparatus wherein a gas generator canister is lowered into a wellbore above a column of fluid in the wellbore and ignited to generate gases for propelling the liquid fracturing fluid into the formation to be fractured without interrupting the continuous delivery of fluid to the wellbore by surface pumps. However, the system and method contemplated by the Riodan, Jr. patent utilizes the gas generator only to boost the flow rate of conventional liquid well treating fluids momentarily and does not develop a preliminary "pad" of gas as part of the initial fracturing process and flowing ahead of a propant laden well treating fluid.

U.S. Pat. No. 4,039,030 to Godfrey et al contemplates the use of an explosive charge and a propellant generator in a wellbore wherein the propellant is detonated first followed by the detonation of a high explosive to maintain pressure of the high explosive over a longer period of time to extend the fractures caused by the explosive while pumping a fracturing fluid into the fractured formation.

An improvement in gas generating and injection devices for perforating a well casing at a production zone and initiating fractures with the production of a propellant gas is disclosed and claimed in U.S. Pat. No. 4,391,337 issued jointly to Franklin C. Ford, Gilman A. Hill and Coye T. Vincent. In this patent a combustion gas generator is provided in the form of a canister which may be suspended in the wellbore and is provided with a plurality of spaced apart shaped charge devices or grenades for perforating the well casing and contigous layer of cement, if used, to provide apertures for the flow of gas and other fluids to be injected into a formation to be produced. The combustion gas generator and perforating device described in the patent to Ford et al may be utilized as part of a gas generator and perforating apparatus in accordance with the system and method of the present invention.

Accordingly, although the prior art suggests the provision of downhole gas generators for use in fracturing operations, the shortcomings of conventional hydraulic fracturing are not sufficiently overcome to make the use of these devices attractive from an economic or technical viewpoint. In conventional hydraulic fracturing, even with the use of downhole propellant gas generators, a substantial amount of hydraulic power capability must be maintained at the surface in the form of large pumping capacity. the energy losses suffered in transmitting the hydraulic fluid through the well pipe or casing cannot be sufficiently overcome to provide the substantial volumes of fluid at pressures required to perform a suitable high stress fracture. Moreover, prior art methods have not provided for a process which will generate suitable fracture initiation and entry into the fractures of a fluid which will satisfactorily open the fractures ahead of the entry of a propant laden fracturing fluid.

SUMMARY OF THE INVENTION

The present invention provides a method for treating a subterranean formation to stimulate the production of fluids, such as liquid and gaseous hydrocarbons, by providing a relatively high stress fracture of the formation which is propagated in several planes in a production zone and to dissipate a propant laden fluid into the fractures for maintaining the fractures open to enhance the flow of fluids into a wellbore from which the fracture was initiated.

In accordance with an important aspect of the present invention the fracturing method includes the precompression of a column of a compressible fracturing fluid in the wellbore and wherein the compressed fluid is released to flow through perforations in a well casing initiated by a device comprising shaped casing perforating projectiles or charges and a combustion gas generator utilizing a solid fuel similar to a rocket propellant to initiate the fracture process. In a preferred embodiment the method contemplates the compression of a slurry or foam type fluid made up of a liquid having dispersed throughout a compressible gas and a solid propant such as granules of sand, glass, bauxite, etc., which fluid is precompressed over a period of time to a pressure of 1,000 psi or more in excess of the normal hydraulic fracture extension pressure of the zone to be fractured. The energy stored in the compressible fluid is released in a rapid decompression process to produce a very high velocity outflow of fracturing fluid behind an initial charge of fracture forming gas which initiates the fracture and deposits a compressed gas "pad" in the formation fractures. The gas is preferably produced at high rates by a combustion gas generator.

In accordance with another aspect of the present invention, there is provided a formation fracturing method utilizing a combustion gas generator and perforating device disposed in a wellbore for perforating a zone to be fractured at a selected one of various levels or depths with respect to the overall well depth and wherein a compressible fracturing fluid is precompressed in the wellbore both above and below the combination perforating and combustion gas generating device for outflow through the apertures formed during the perforation and gas generation process.

In accordnace with still a further aspect of the present invention a formation fracturing system and method is provided wherein at least two combustion gas generators are spaced apart in a wellbore filled with a propant laden, compressible fracturing fluid. The provision of at least two combustion gas generators in the wellbore spaced apart from each other and at predetermined positions relative to the overall length of the wellbore may produce pressure pulses which are propagated up and down the well casing, and the upper gas generator spaced from the lower gas generator may provide a relatively large accumulator/filter to attenuate the propagation of compression or decompression pulses upward or downward through the wellbore and to modulate the flow velocities and pressure gradients in the fracturing fluid disposed in the wellbore prior to its outflow through the perforated area.

The upper gas generator decouples the fluid between the two gas generators from the fluid in the wellbore above the upper gas generator, so that the inertia of the fluid above the upper gas generator need not be overcome as the fluid expands into the formation. Moreover, should the wellbore be shutoff, additional lengths of conduit or pipe can be connected to the wellbore on the surface to provide the needed accumulator effect.

The gas generator which is spaced a distance for the perforations also provides for imparting high flow velocities to a charge of compressible fracturing fluid initially located between the gas generators out through the perforations and into the formation being fractured. Subsequently, the gas generated by the gas generator spaced from the perforations will also flow out through the perforations and rapidly dissipate through the formation porosity to permit acceleration of the major portion of fracturing fluid within the wellbore above or below the gas generator. The relatively viscous compressible fracturing fluid will enter the reduced width fractures resulting form dissipation of the gas charge at high velocity and then be partially decelerated to increase the fluid pressures in the reduced width fractures to reopen and propagate the fractures.

The present invention further contemplates the provision of a well formation fracturing system including one or more combustion gas generators which are totally consumed in the well casing to eliminate any residual fragments or objects which may interfere with production from the well formation and which are adapted to provide for the generation of substantial gas volumes at high pressures over a relatively short period of time. The gas generators may be provided in modular form in accordance with the total volume of gas to be generated for a particular fracturing operation.

The system and method of the present invention provides for producing fractured subterranean formations for stimulating the production of oil and gas, in particular, although those skilled in the art will recognize that other purposes may be served by the formation fracturing or well treating system and method of the present invention. Those skilled in the art will also recognize that the method utilizes essentially conventional well equipment which does not require any substantial modification and that wells which have been previously stimulated may be reworked using the gas generating and fracturing fluid decompressing method of the invention. Those skilled in the art will recognize advantages and superior features of the invention other than those described hereinabove upon reading the detailed description which follows in conjunction with the drawing.

DESCRIPTION OF THE PREFERRED EMBODIMENTS

Figure 1:
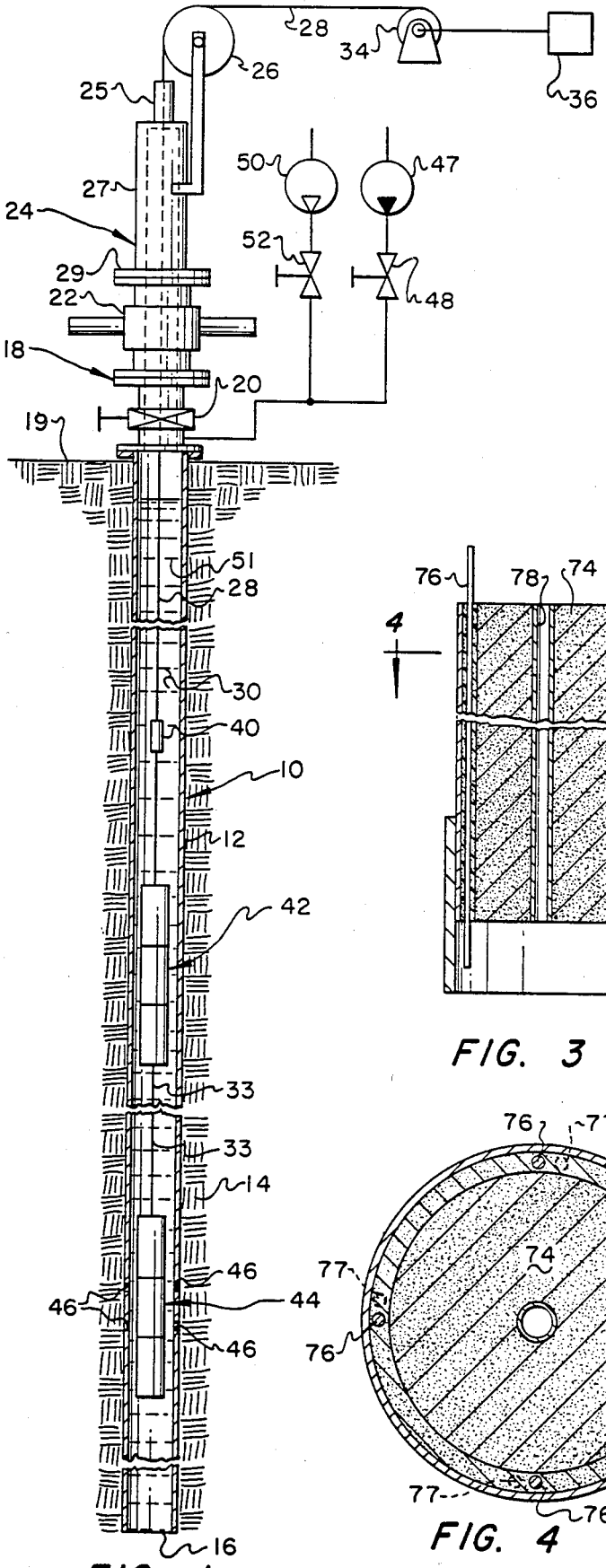
FIG. 1 is an elevation in somewhat schematic form of a wellbore and subterranean formation with the fracturing system of the present invention in position to be actuated to provide a fracturing operation.

In the description which follows like components are marked throughout the specification and drawing with the same reference numerals, respectively. The drawing figures are not necessarily to scale and certain features may be shown exaggerated in scale or in somewhat schematic form in the interest of clarity and conciseness.

The method and system of the present invention are particularly adapted for the use in fracturing subterranean formations under a variety of geological conditions but, in particular, for fracturing relatively low permeability, tight sand, gas and liquid hydrocarbon reservoirs. Referring to FIG. 1, for example, there is illustrated a well, generally designated by the numeral 10, formed by an elongate cylindrical casing 12 of conventional construction and extending into a rock or tight sand subterranean formation 14. The depth of the well 10 may range from several hundred to several thousand feet and it is contemplated that the method and system of the invention may be used in conjunction with a wide variety of wells over a substantial range of well depths wherein, for example, a substantial number of different production zones may be stimulated in accordance with the invention. The casing 12 will be described further herein as conventional steel well casing although other materials can be used.

The casing 12 extends to a bottom plug 16 at the maximum depth of the well 10 and the casing extends to a conventional wellhead 18 at the surface 19. Although a specific example of carrying out the method of the present invention will be described herein, the wellhead components for the well 10 may be selected from a variety of commercially available equipment. Typically, the wellhead 18 includes a valve 20 above which a blowout preventer 22 is mounted. A conventional wireline lubricator assembly 24 is mounted on the wellhead 18 above the blowout preventer 22 and includes a stuffing box 25 and a top block 26 for reaving a conventional wireline 28 thereover and down through the stuffing box, lubricator 24, blowout preventer 22 and the valve 20 into the interior space 30, comprising the wellbore. The lubricator 24 preferably includes a hollow riser section 27 and suitable coupling means 29 for connecting and disconnecting the lubricator with respect to the wellhead 18. The wireline 28 is typically trained over a drum type hoist 34 for paying out and reeling in the wireline. A suitable control console 36 is connected to the wireline 28 via the hoist 34 for receiving and transmitting signals through the wireline 28 for the operations to be described herein.

As shown in FIG. 1, the wireline 28 extends downward to an instrument unit 40 having suitable depth measuring and pressure measuring instruments adapted to transmit depth and pressure readings to the controller 36. In the exemplary arrangement of FIG. 1, the wireline 28 also extends downward to and through an upper gas generator unit, generally designated by the numeral 42. A second section of wireline 33, which may also be a consumable electrical signal transmitting cable or an ignitor cord type fuse, extends from the gas generator 42 to a second gas generator and casing perforating unit, generally designated by the numeral 44. The gas generating unit 44 is preferably disposed about 100 ft. to 500 ft. below the gas generating unit 42 and is adapted to generate a quantity of high pressure gas as will be described further herein and to perforate the casing 12 to provide a plurality of perforations or apertures 46, as indicated in FIG. 1. The wellbore 30 is also operable to be in communication with a source of a compressible fracturing fluid by way of a pump 47 and a control valve 48. A source of compressed gas, not shown, may be placed in communication with the wellbore 30 by way of a gas pump 50 and a suitable shutoff or control valve 52.

Generally speaking, the present invention contemplates the provision of at least the gas generator and perforating unit 44 at a selected depth in the wellbore 30, and wherein the wellbore is filled with a quantity of compressible fracturing fluid 51, FIG. 1, preferably comprising a slurry or foam made up of a suitable liquid such as water in which a relatively high concentration of abrasive propant such as sand, glass, mica, or bauxite is dispersed in suspension. The fracturing fluid is also injected with compressed gas to provide a foam quality or gas content by volume in the range of about 40 percent to 80 percent of the total volume of the fracturing fluid thereby allowing the effective transportation of the solid propant and suitable compression of the fluid as will be described herein. Those skilled in the art will recognize that other compressible, propant carrying fluid compositions may be utilized in practicing the present invention.

For performing fractures at formation depths in the range of 5,000 feet to 10,000 feet and wellbore pressures, prior to performing a fracturing operation of from 9,000 psi to 13,000 psi, a foam quality of about 62 percent to 70 percent is preferable with a sand propant concentration of typically about 5.0 lbs. to 7.5 lbs. of sand per gallon of foam and providing a total density of fluid 51 of about 9.5 lbs. to 11.0 lbs. per gallon. The wellbore 30 is at least partially and preferably completely filled with the compressible fracturing fluid 51 having the abovementioned physical properties and, over an extended period of time, the pressure in the wellbore is increased by pumping fluid into the wellbore to about 1,000 psi or more in excess of the normal pressure required to extend a fracture at the depth of the formation to be perforated. The pressure required to extend a fracture is determined to be that which exceeds the least principal stress in the formation at the depth of the zone to be fractured which may be assumed to be approximately 0.77 psi per foot of depth.

Upon increasing the fracturing fluid pressure to the abovementioned value, the casing 12 is then perforated to form the apertures 46 to release the potential energy stored in the compressed fracturing fluid and virtually simultaneously generation commences of substantial volumes of high pressure gas from the gas generators. A rapid decompression process occurs to produce a very high velocity outward expanding charge of high pressure gas flowing through the casing perforations or apertures 46 followed by expansion and outflow of the propant laden fracturing fluid 51 into the network of rapidly expanding high stress fractures initiated in the formation. If more than one gas generator is disposed in the wellbore the flow process will typically involve an initial flow of high velocity and high pressure gas followed by a charge of expanding propant laden fracturing fluid of the type described herein and followed by a second charge of gas and then a second charge of propant laden fluid to develop a fracture zone superior to that provided by conventional foam hydraulic fracturing. By precompressing the volume of fracturing fluid in the wellbore, followed by the generation of high pressure gas and the release of the gas and the compressed fluid, an effective hydraulic horsepower delivery is experienced which is equivalent to several thousand times the average power used to store the potential energy created during the cycle of compressing the fracturing fluid in the wellbore. Thanks to the provision of a second gas generator above the first generator the mass of fluid in the wellbore above the second generator is effectively decoupled from the mass of fluid between the generators during the decompression or outflow process.

During at least the initial phases of producing gas by the generating units 42 and/or 44, after perforation of the well casing, the gases and the following expanding fracturing fluid will flow through the casing apertures 46, for example, at sonic velocity as a limiting velocity and will cut extensive channels or slots into the formation. Beyond the channels formed by fluid erosion the pressure of the fluids flowing outwardly will create one or more high stress fractures in the formation resulting in the initiation or extension of a multiplicity of fractures and wherein the expanding fracturing fluid will carry the propant material into the fractures to hold them open. After the initial pressure of the expanding fluid subsides, the normal hydraulic fractures along the planes in the formation perpendicular to the least principal stress in the region will continue to propagate outward from the immediate vicinity of the wellbore.

The provision of one or more gas generators of the type to be described in further detail herein provides an improved high stress fracture initiation and a substantially clean gas flow to form a "pad" of gas which opens the fractures ahead of the flow of propant laden compressible fracturing fluid. The provision of this gas pad prevents premature blockage or sand off of the newly created fractures and as the gas production rate declines a gradually increasing proportion of the flow into the formation will be the exemplary propant carrying form type fluid. If a second gas generator is provided uphole from the first generator, as illustrated in FIG. 1, a second charge of gas will exit the wellbore through the perforation apertures and leak off into the formation rapidly and resulting in an increase in velocity and kinetic energy of a column of propant laden fracturing fluid accelerating down the well casing behind the slug of gas generated by the uphole generator. When this high velocity charge of fracturing fluid arrives at the apertures 46, a high pressure impulse will occur in the apertures and the adjacent fractures.

Accordingly, during the time that the second charge of low viscosity gas is flowing through the fractures without any compressible fracturing fluid mixed therein it will rapidly dissipate thereby momentarily reducing the width of the fractures. As the second charge of compressible fracturing fluid enters the reduced width fractures at high velocity the kinetic energy of the foam type fluid will be partially converted to potential energy by fluid pressure increase. Moreover, the fractures previously opened have created new stresses and the increased fluid pressure occuring when the second charge of compressible fracturing fluid hits the partially collapsed initial fracture may exceed the pressure required to open new fractures. These fractures are normally perpendicular to the normal fracture grain of the area being fractured and may cut across many natural fractures thereby significantly increasing the area stimulated and resultion in greater well productivity.

The abovementioned cross grain fractures may be created by the impulse of the initial charge of gas released concurrent with the perforation of the well or upon the impulse created by the second charge of propant laden foam fluid entering the formation behind the second charge of gas. The propped cross grain fractures may of relatively short length but they also make a major contribution to formation yield if they cut across preexisting natural fractures even though the major portion of the fracturing fluid will extend and prop open the normal hydraulic fractures which are oriented perpendicular to the direction of the least principal stress in the zone being fractured.

The decompression process of the fracturing fluid may last anywhere from three seconds to ten seconds depending on the volume of fluid in the wellbore, the perforation aperture flow area and the physical characteristics of the formation. As the flow rate into the fracture zone decreases and the leak off of fluid into the formation becomes larger than the inflow rate of fluid the fracture widths will decrease until the sand propant bridges and plugs the fracture resulting in a termination of fracture injection or sandoff. Once sanding off has occurred, a continuing slow leakage of the fracturing fluid out into the fracture zone will occur while propant material strains out and fills the erosion channels behind each casing aperture or perforation and then fills the perforation holes themselves. A sand cake or pod will build over each perforation effectively sealing the apertures against any further breakdown and passage of fluid into the zone during subsequent fracturing operations on other zones.

Figure 3:
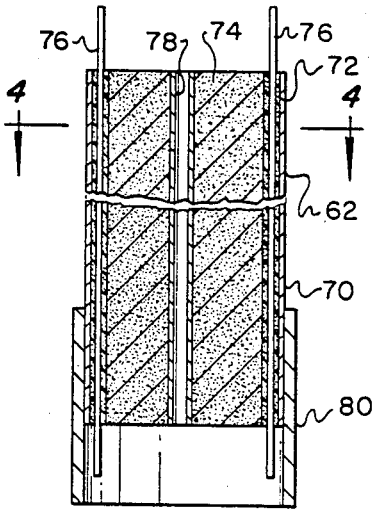
FIG. 3 is a longitudinal section view of one of the combustion gas generator sections.
Figure 4:
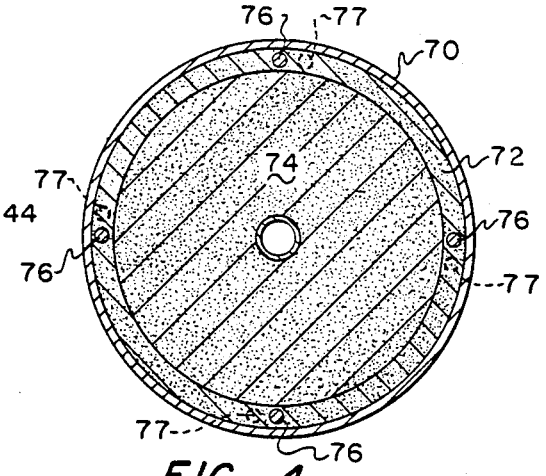
FIG. 4 is a section view taken along the line 4—4 of FIG. 3.
Figure 2:
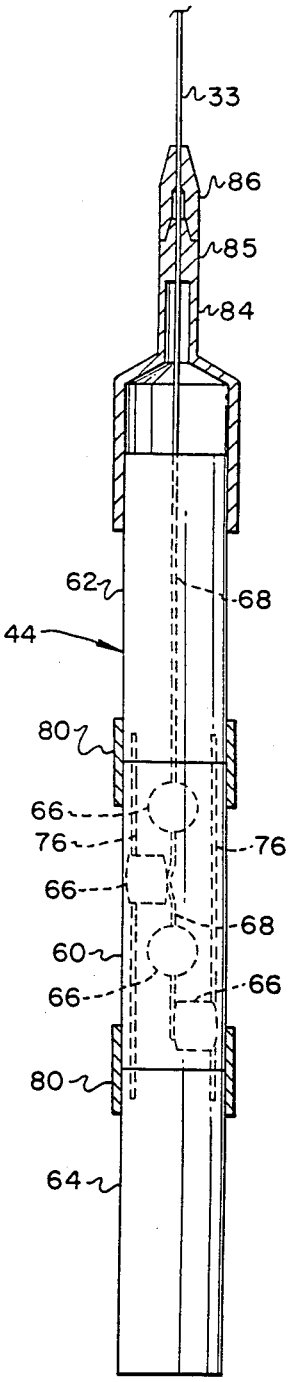
FIG. 2 is an elevation view, partially sectioned, of the lower combustion gas generator including the section with the casing perforating charges.

One preferred embodiment of a gas generator and perforating device 44 will now be described in conjunction with FIGS. 2 through 4. The gas generator 42 is similar to the generator 44 except it is not provided with perforating charges. The gas generator 44 may be sized according to the diameter of the wellbore, the depth of the formation to be penetrated and the total energy to be imparted to the fracturing operation. In a well in the range of 6,000 to 10,000 ft. depth and provided with a standard steel casing of nominal 5.5 inches diameter it is contemplated that the gas generator 44 should be designed to initially produce about 500 standard cubic feet of gas within about 0.05 to 0.2 milliseconds after ignition followed by the generation of about 1750 standard cubic feet of gas over the next 200 to 250 milliseconds. The gas generator 44 preferably comprises a plurality of generator sections 60, 62 and 64. The center section 60 includes a plurality of axially spaced and radially directed perforating shaped charges 66 constructed and arranged according to the shaped charges described in U.S. Pat. No. 4,391,337. The subject matter of U.S. Pat. No. 4,391,337 is hereby incorporated by reference into this application as regards the description of the gas generator unit 44. The shaped charges 66 are interconnected by a fast burning fuse 68 such as a Primacord type fuse or other suitable ignition signal carrying means which is ignited by a suitable device which receives an electrical signal transmitted down the wireline 28. Otherwise, the gas generator section 60 is constructed similar to the sections 62 and 64 in accordance with the description herein.

It is contemplated that the gas generator sections 60, 62 and 64, may be made of standard lengths and assembled according to the total amount of gas to be generated in the wellbore. Preferably each gas generator section is constructed generally like the generator section 62, illustrated in FIGS. 3 and 4. Each section such as the section 62 includes a cylindrical thin walled outer canister member 70, which is preferably made of a frangible material such as glass, ceramic or brittlized aluminum alloys which will burst and disintegrate into fragments smaller than 0.10 inches diameter. Alternatively, the outer canister member 70 may be made of a plastic material which is yieldable to allow wellbore pressures to be transmitted directly to the combustion material disposed within the canister member. The upper gas generator section 62 is preferably provided with a substantially solid mass of gas generating propellant which may include, if necessary, a fast burn ring 72 disposed adjacent to the canister member 70 and a relatively slow burn core portion 74 within the confines of the ring 72. Four elongated Primacord type fuses 76 are preferably embedded in the fast burn ring 72 and extend longitudinally through the generator section 62 and may extend a short distance from either end, as illustrated in FIG. 3. In this way, adjacent gas generator sections may be assembled to each other and pyrotechnically connected to each other by drilling a series of holes 77, FIG. 4, in the end face of each section adjacent to the Primacord fuses 76 wherein the fuses extending from one section may be inserted into the holes provided in the adjacent section to assure continuity of ignition between sections. Each gas generator section other than the center section 60 is also provided with an elongated bore 78 through which the wireline, electrical conductor wire or fuse leading to the center or perforating charge section may be extended.

Each gas generator section such as the sections 62 and 64 is also preferably provided with a short cylindrical coupling portion 80 comprising a sleeve which may be extended over the adjacent gas generator section and suitably secured thereto, such as by an adhesive, when making up the generator 44 comprising the plural sections 60, 62 and 64. The combustion material making up the outer fast burn ring 72 is preferably of a type such as used in the production of solid fuel rocket motors and the inner core portion 74 is preferably a relatively slow burning propellant material such as potassium perchlorate. The fast burn ring 72 will effectively ignite the inner core which may, for example, be designed to burn radially inwardly at a rate of about 5 or 6 inches per second. The very rapid production of combustion gas should, of course, effectively shatter and fragment the outer canister member 70 or otherwise consume the material thereof so that it does not comprise debris which could block the wellbore 30 or the apertures 46 subsequent to the ignition of the gas generators.

Typically, the generator section 60 may be in the range of 7.0 to 10.0 ft. in length for a wellbore having a 5.5 inch casing outside diameter, for example, with four perforating charges 66 arranged in the generator section 60 in the abovementioned 90 degree circumferential pattern and with 3.0 inch vertical spacing between each charge to provide 5 charge per foot of length.

Preparation of the generator section 60 may be generally in accordance with that described above for the generator sections 62 and 64, followed by the drilling of properly located holes for each of the perforating shaped charges 66. The charges 66 are then typically inserted in the holes and the holes filled with an epoxy material to hold the charge in place and to provide a pressure tight seal with the outer canister member. The shaped charge inserts 66 may be connected to a central Primacord fuse 68 as described above or surrounded with fast burn pyrotechnic material in the receiving holes to provide ignition communication between the fast burn outer ring 72 and the charge itself. In accordance with the overall method contemplated by the present invention, the cumulative cross sectional area of the apertures 46 formed in the well casing 12 created by the perforating charges 66 should be equal to or smaller than the cross sectional area of the casing inside diameter. For example, for a nominal 5.5 inch outside diameter well casing and with 28 perforating charges spaced over a 7.0 ft. length of the generator section 60, the charges 66 should be designed to provide perforation diameters of about 0.88 to 0.9 inches. The depth of penetration of the charges does not need to be more than about 3 to 4 inches since penetration of the casing 12 and any annular cement sheath disposed therearound is all that is required for the perforation process.

As discussed previously, the gas generators 42 and 44 may be made up of plural sections such as the sections 62 and 64 and, of course, at least one of the gas generators is provided with a section 60 containing the perforating charges 66. The generator sections are joined together as described above using the coupling portions 80 which are preferably also of a shatterable or otherwise disintegrating type material. The upper generator section 62 is then suitably joined by a coupling member 84, FIG. 2, to a conventional wireline rope socket 86. The coupling member 84 includes a stem portion 85 which is suitably threaded or otherwise provided with means for connection to the rope socket 86. The ignition signal cored or fuse 68 is extended down through the bore 78 in the upper section 62 and connected to suitable ignition means for igniting the shaped charges 66 and the fast burn ring 72 of the center section 60. Alternatively, the Primacord fuse member 76 at the upper generator section 62 may be connected to suitable ignition means, not shown, to be supplied with an electrical signal from the wireline cable. The conductor or fuse 68 should be constructed of a material which will be burned, melted or otherwise destroyed by the combustion of the generator sections 60, 62 and 64. Moreover, the coupling 84 and the rope socket connector 86 should also be constructed out of frangible material which will be fragmented or consumed by combustion of the gas generator sections 60, 62 and 64. Any non fragmented portion of the rope socket connector 86 should be small enough to be retrieved through the wellhead 18 and preferably also the stuffing box 25 of the lubricator 24.

The generator 44 for use in a 5.5 inch diameter gas well casing typically would consist of three parts including the section 60 as described above and the sections 62 and 64 including collectively about 0.7 cubic feet of solid pyrotechnic material capable of generating about 500 standard cubic feet of combustion gas over a period of about 10.0 to 25.0 milliseconds. The burn rate for this material should range from about 10 to 30 feet per second and the material may be contained partially in the space formed between the shaped charges 66 plus an additional approximately ten feet of 3.25 inch diameter canister member 71. The total length of the canister member containing the 7.0 to 10.0 foot section of perforating shaped charges plus the extra volume for this quantity of pyrotechnic material would be approximately 20 feet in length. Additionally, about 2.3 cubic feet of solid rocket fuel propellant should be provided and having a capability of generating about 1600 standard cubic feet of gas over a period of about 200.0 to 350.0 milliseconds. The burn rate for this quantity of gas generating material should range from about 4.5 to 8.0 inches per second in a radially inward burn mode (when such a mode is employed) from the multiple igniters such as the Primacord fuses 76 or similar igniters disposed near the circumference of the canister members. This material would typically be contained in two canister members such as the sections 62 and 64 or the sections 62 or 64 may be placed adjacent to each other and above the section 60, for example. The total generator length would be about 40 feet when based on a 3.25 inch outside diameter. Moreover, additional sections of the configuration described above could be added depending on the volume of the zone to be fractured. The igniters used to initiate the propellant burn may also be of the type known as TLX igniters or Nonel igniters as used in aerospace and commercial applications, respectively.

As described previously, the outer skin or canister member 70 of the gas generator sections 60, 62 and 64 may be made of a suitable plastic material such as 0.0625 inch thickness extruded Halar or Kel-f. This material is deformable under pressure so that well fluid pressures may be transmitted through the outer skin and into the solid core of the pyrotechnic propellant material. All components of the system should be designed to survive wellbore pressures of up to about 15,000 psi and the outer canister members must be capable, of course, of preventing leakage of water or other wellbore fluids into the gas generating material for periods of about one to four hours. The outer canister members must also have sufficient tensile strength to hold the weight of the contents of the generator sections 60, 62 and 64. Additionally, the gas generating material described hereinabove for the gas generator sections 60, 62 and 64 may be adapted for implanting therein very hard abrasive granules such as crushed, ragged grains of bauxite or the like. The aforedescribed gas generated 42 and 44 are somewhat exemplary and it will be understood that other forms of gas generators may be employed to provide the gas flow characteristics described herein.

The characteristics and procedure for fracturing a formation in a well 10 provided with a well casing 12 as illustrated in FIG. 1, will now be described in conjunction with FIG. 1 and FIGS. 5 and 6. By way of example, it will be assumed that the well depth provided by the casing 12 is about 8,000 feet and that a fracture is to be performed by perforating the casing 12 at a depth of 6,000 feet using a fracturing fluid having a foam quality of about 62 and 70 percent and made up basically of water with conventional fracturing fluid additives, nitrogen gas and a sand suspension preferably in the range of about 5.0 pounds to 7.5 pounds of sand per gallon of foam to provide a total foam fluid weight of about 9.5 pounds to 11.0 pounds per gallon.

Figure 5:
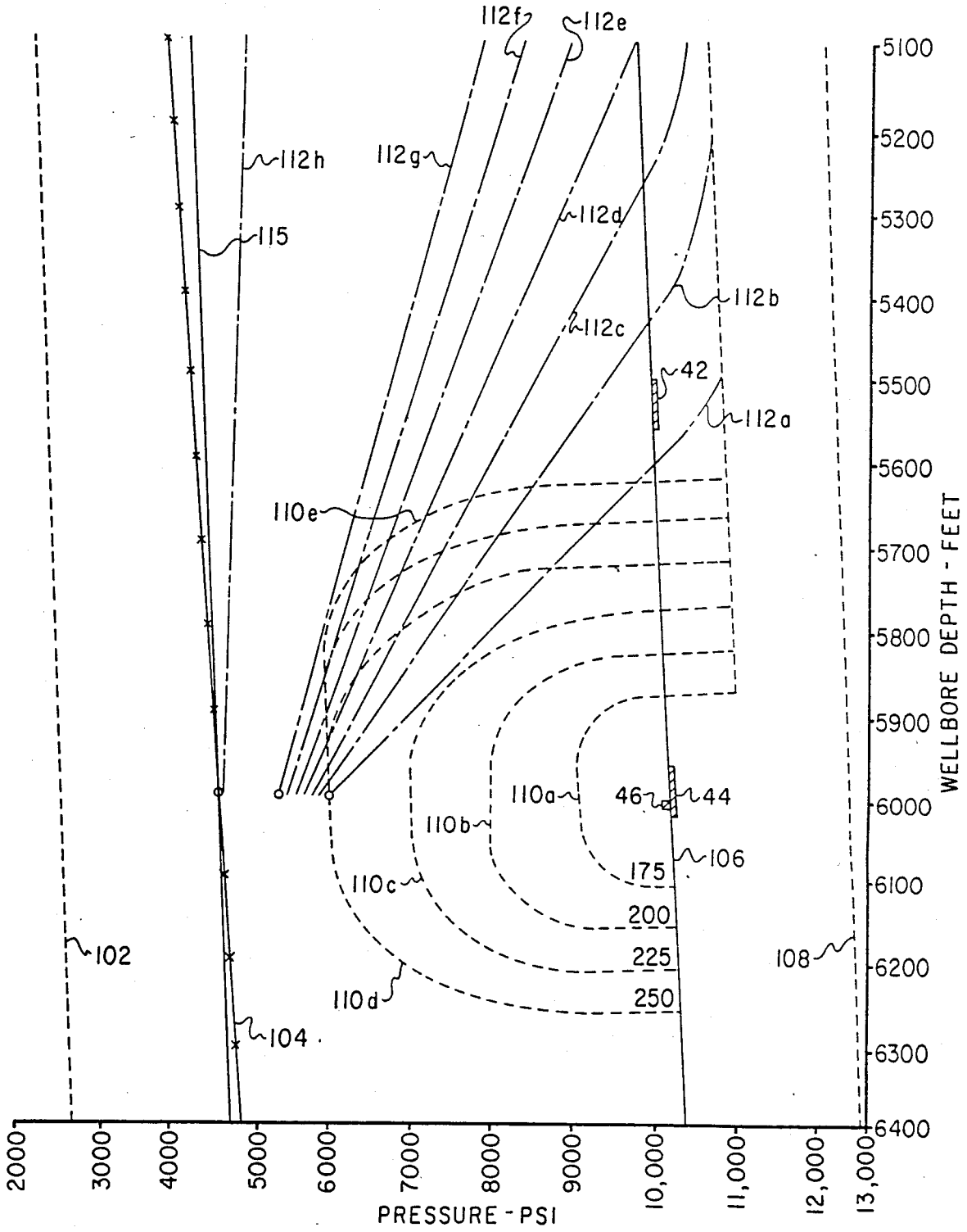
FIG. 5 is a diagram illustrating the pressure gradients in a typical wellbore and in an exemplary zone before and after a fracturing operation in accordance with the method of the invention.

Prior to the initial perforating and fracturing process the generating units 42 and 44 are inserted in the wellbore 30 through the lubricator 24 and are suitably connected to the wireline 28 and spaced apart in the wellbore about 500 feet as indicated in FIGS. 1 and 5. The wellbore 30 is then filled with fracturing fluid 51 of the above mentioned characteristics which, for a 5.5 inch diameter steel casing having a wall thickness to provide a casing weight of about 20 pounds per foot, will hold about 950 cubic feet of fluid. Fracturing fluid 51 is injected into the casing 12 until, for example, wellbore pressure at the surface is increased to about 7,000 psig. This will provide a prefracturing pressure in the wellbore at 6,000 feet depth of about 10,200 psig which stresses the casing 12 to a point less than its yield strength and exceeds the formation fracturing extension pressure at 6,000 feet by about 4,700 psi.

Referring to FIG. 5, there is illustrated a diagram of pressure in psi versus well depth in feet. The line 102 indicates an assumed formation gas reservoir pressure gradient and the line 104 indicates the pressure required to extend a hydraulic fracture at a selected depth. The line 106 indicates the fluid pressure gradient in the wellbore 30 for a pressure at the surface of 7,000 psi prior to igniting the gas generator units 42 and 44 and simultaneously perforating the casing 12. The location of the gas generating units 42 and 44 are indicated to be at the 5,500 and 6,000 ft. depths, respectively. The line 108 indicates the yield strength in psi of the casing 12 without a cement enclosure.

The dashed lines 110*a*, 110*b*, 110*c*, 110*d* and 110*e* indicate the pressure profile along the length of the casing 12 above and below the perforations 46 at various time intervals in milliseconds, as indicated, from about 175 milliseconds to 300 milliseconds based on a total aperture flow area for the apertures 46 equal to the cross sectional flow area of the wellbore 30 to match the foam fluid decompression flow from above and below the apertures. If the perforation apertures are made at or near the bottom of the well casing 12 or the bottom of the effective depth of the wellbore 30 the cross sectional flow area may be made approximately equal to the casing or well bore cross sectional flow area. The pressure gradient lines 110*a* through 110*e* also assume that gas is being generated at a rate approximately equal to or slightly in excess of the exit flow rate through the casing perforation apertures 46 at a sonic velocity of about 2,500 to 2,800 feet per second.

The series of lines 112*a* through 112*h* in FIG. 5 indicate the assumed pressure gradient in the wellbore 30 above the perforation apertures 46 at intervals of 600, 900, 1,000, 1,200, 1,400, 1,600, 1,800 and from 5,000 to 10,000 milliseconds after casing perforation, respectively. The pressure gradients generated during these time intervals are based on flow rates through the apertures 46 governed by normal friction loss resistive flow through the casing assuming that about 400 cubic feet of compressible fracturing fluid has flowed out through the perforation apertures over a time interval of about 5.0 to 10.0 seconds after ignition of the gas generating units 42 and 44. The line 115 indicates steady state post fracture pressure in the wellbore 30.

Figure 6:
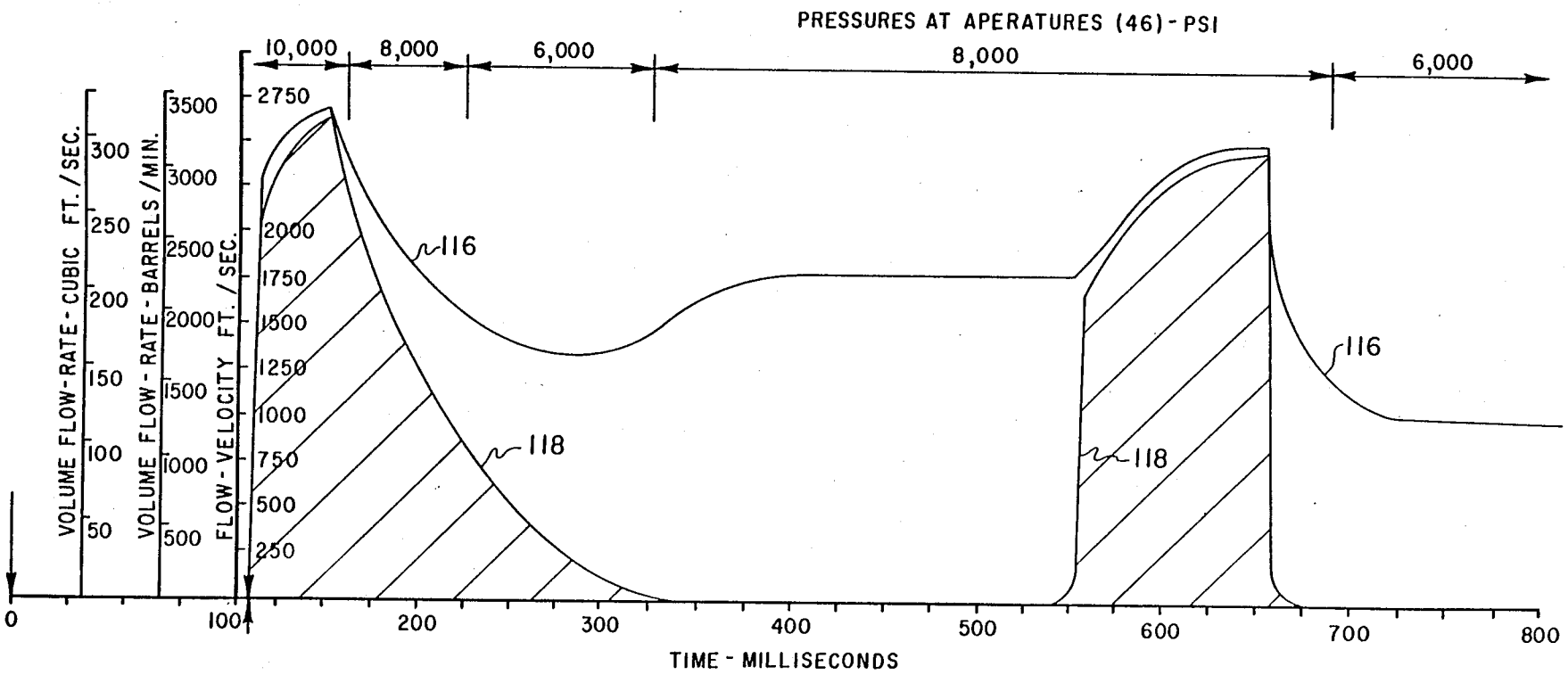
FIG. 6 is a diagram illustrating the flow characteristics of gaseous and foam fluids into a formation subsequent to ignition of the gas generators.

FIG. 6 illustrates the flow characteristics of the fluids entering the formation versus time based on an ignition of the gas generating unit 42 at time 0 and detonation of the perforating shaped charges 66 at approximately 110 milliseconds. The line 116 indicates total flow of gas generated and foam fluid exiting the wellbore 30 through the apertures 46 versus time and the line 118 indicates the flow rate of gas exiting through the apertures 46 at the 6,000 ft. depth for a decompression pressure change of about 4,700 to 5,000 psi and injection of approximately 350–400 cubic feet of foam type fracturing fluid carrying approximately 15,000 to 18,000 pounds of sand. As indicated by the area under the lines 116 and 118, from a period of about 110 milliseconds to 200 milliseconds a substantial portion of the total flow through the perforations is gas generated by the gas generating unit 44 with increasing amounts of flow of fracturing fluid 51 starting at about 150 milliseconds up to the arrival at the apertures 46 of the charge of gas generated by the generating unit 42 at approximately 550 milliseconds.

During the time interval between the detonation of the perforating shaped charges 66 and the arrival of the flow of gas from the generating unit 42, approximately 55 cubic feet of foam type fracturing fluid (at 10,000 psi) and 2,500 to 3,000 pounds of sand will be injected comprising the charge of fracturing fluid in the wellbore 30 between the gas generating units 42 and 44. In the time interval of from about 550 milliseconds to 660 milliseconds a second charge of compressed gas will enter the perforated zone followed by the remaining 295 to 345 cubic feet of foam fluid which is injected over a gradually decreasing flow rate until sandoff occurs at the perforation apertures over a time interval of about 5 to 10 seconds after ignition of the gas generating units.

The first 10 to 20 milliseconds of gas generation or combustion of the pyrotechnic material in the units 42 and 44 should be such as to generate gas at a rate approximately equal to the exit flow rate through the perforations to thereby maintain a substantially constant pressure in the wellbore 30. If combustion gas generation exceeds the exit flow rate the fracturing fluid in the wellbore will be compressed to create a positive pressure pulse propagating up and down the casing 12. Of course, if the gas generation rate declines below the fluid exit flow rate the fracturing fluid will expand and flow out through the apertures 46 along with the combustion gas and also generate a negative pressure pulse propagating up and down the casing 12 from the location of the gas generating units.

As mentioned above, the preferred system contemplates a gas generation rate approximately equal to or slightly in excess of the exit flow rate at a sonic velocity assumed to be about 2,500 to 2,800 feet per second. This combustion rate should be maintained for at least 20 milliseconds to 40 milliseconds and thereafter the rate of producing gas from the generating units 42 and 44 can decrease with time to permit outflow from the perforation apertures to change from a predominantly clean gas pad to progressively less gas and more foam type fracturing fluid as indicated by the flow characteristics illustrated in FIG. 6. The injection of fluids into the perforated formation at pressures of from 1.2 to 1.5 psi per foot of depth is far in excess of the normal 0.77 psi per foot of depth of natural rock stress.

FIG. 6 illustrates the flow rates for the 5.5 inch diameter casing 12 assuming no significant depth of casing below the point of perforation to form the apertures 46. It may also be assumed that the short length of casing 12 extending below the perforation apertures will act somewhat like a one quarter wave length resonating pipe in regard to the foam fluid decompression pulse if friction losses along the flow path are not too large. When the decompression pulse reaches the casing bottom 16 it will be reflected back up the wellbore 30 as an additional decompression wave of equal magnitude although friction losses from the casing walls plus losses from fracturing said cake built up over prior perforations may greatly reduce the flow rates and the consequent pulse magnitude.

Accordingly, it is contemplated that a subterranean formation fracturing process carried out in accordance with the characteristics described herein and illustrated in the drawing, may carry into the fracture at least about 15,000 pounds of propant for each zone fractured. Although the gas generated by the gas generating units 42 and 44 may provide only about 10 percent of the fluid volume and energy used in the process, the essentially sand free gas pads which are used to initiate the fractures at the instant of perforation and to open the fractures wide enough to accept the heavily sand laden compressible fracturing fluid provides an improved formation fracture. Assuming 15,000 pounds of sand is expelled into the formation and having a volume of about 128 cubic feet, about 6,000 to 8,000 square feet of fracture area may be propped open assuming an average fracture width of about 0.25 inches. The effectively fractured area may range from 50 feet to 100 feet in diameter from the wellbore 30.

As described briefly previously herein, as the flow rate into the fractures decreases and bleed-off into the reservoir becomes larger than the inflow rate the sand propant will eventually bridge and plug the fracture at the perforation apertures to terminate the injection process. The continuing slow leak of foam type fracturing fluid into the porous propant material around the perforations will strain out additional sand to fill the erosion channels in the formation immediately adjacent each perforation and then fill the perforation apertures 46 themselves until packed sand cake is provided at the apertures to effectively seal the formation against any further breakdown and significant pasage of fracturing fluid during subsequent fracturing operations on other zones. In this regard, the wellbore 30 is maintained at a pressure sufficient to prevent reverse flow and breakdown of the pressure sealed apertures and to prepare the wellbore for pressure buildup to the point required for the next fracturing operation.

The maintenance of a substantial fluid pressure in the wellbore 30 in the range of 2,000 to 3,500 psi at the wellhead 18 requires that the lubricator 24 be provided with a stuffing box such as the stuffing box 25 or other means capable of preventing the hydraulic extrusion of the wireline 28 out of the wellbore. Moreover, the insertion of new gas generating units in preparation for a subsequent fracturing operation will require that the weight of the generating units exceed the hydraulic force on the wireline at the stuffing box. For example, a wireline having a diameter of about 0.22 inches and subject to a pressure of 2,000 psi at the wellhead will be subject to a buoyancy force of about 75 pounds. Therefore, the total net weight of the gas generating units 42 and 44, for example, should exceed the net buoyancy force on the wireline 28 in order to cause the wireline to be pulled downward by gravity for running the new generating unit set into the wellbore 30. The buoyancy effect of the foam type fracturing fluid remaining in the wellbore 30 acting on the new set of gas generating units inserted therein may be reduced by injecting a column of compressed gas into the wellbore to displace the heavier foam fluid in the upper portions of the casing 12. Moreover, rapid pumping of new quantities of fracturing fluid downward into the wellbore after insertion of the gas generating units can facilitate downhauling of the generating units due to a substantial downward hydraulic drag force.

The gas generating unit 44 may be inserted into the wellbore 30 using the lubricator 24 and connected to the section of wireline or igniter cord 33 interposed between the two gas generating units. After the generating unit 44 has been run into the wellbore to the depth permitted by the length of the wireline or cord section 33 the blowout preventer 22 may be closed over the cord section 33 and the pressure in the lubricator 24 bled off to permit its removal and mounting of a second duplicate lubricator, not shown, containing the upper gas generating unit 42 plus the instrument unit 40 and with the wireline 28 threaded through the stuffing box 25. The mounting operation may be carried out using conventional equipment such as a ginpole or derrick, not shown.

Prior to mounting the second lubricator on the coupling 29, for example, the top of the wireline or igniter cord section 33 is connected by a suitable connector, not shown, to the generating unit 42. Alternatively, the lubricator 24 may be used wherein the gas generating unit 42 and the instrument unit 40 are disposed in the riser section 27 and the lubricator is reconnected to the wellhead 18 by way of the coupling 29. When the second lubricator unit has been properly mounted it may be pressurized with nitrogen or goam fluid to equalize the pressure in the lubricator riser section and in the wellbore below the blowout preventer 22. The blowout preventer 22 can then be reopened and the gas generating units 42 and 44 lowered to the desired depth for the next fracturing operation. During the time that the new set of generating units 42 and 44 are being lowered to the selected zone to be perforated the pump 47 may be operated to inject additional quantities of compressible fracturing fluid required to recharge the wellbore 30.

A typical pump-in volume required to recharge a 5.5 inch diameter casing of 10,000 ft. depth between each fracturing operation is estimated to be approximately 80,000 standard cubic ft. of nitrogen gas to produce 66 percent quality foam at 8,500 psi and 140° Fahrenheit, 20.8 barrels of water and additives and 18.9 barrels of fracture propant sand (17,750 pounds) for a total of approximately 80 barrels of fluid. Using a maximum sand concentration of about 20 pounds of sand per gallon of water slurry during pump-in the pumping rate is about 4 barrels per minute thereby requiring about 10 minutes to pump approximately 40 barrels of the water-sand slurry. If the gas generating units 42 and 44 are lowered through the static fluid column in the casing 12 at a rate of about 500 ft. per minute before starting the foam injection then after starting the foam injection the fluid will be flowing downward at about the same rate as the gas generating units. After the normal foam injection rate has been established, the wireline running speed can be increased to about 300 to 400 per minute faster than the foam fluid velocity or up to about 700 feet per minute so that the generating units 42 and 44 are actually falling at about a 300 to 350 ft. per minute rate relative to the fluid flow rate. The total running time should be no more than about ten minutes for a 5,000 ft. deep fracturing zone.

Wellbore recharge is completed when the surface wellhead pressure reaches about 2,000 psi below the API rated casing internal yield pressure. At this time, the system is then fully recharged and is ready for another decompression fracturing and stimulating operation. The location of the gas generating units 42 and 44 may be identified using one of several depth measuring techniques.

If several perforations and fracturing operations are carried out at vertically separated zones or if it is desired to reach a point in the wellbore 30 below a fractured zone, the buildup of sand cake over each perforation aperture 46 after a fracturing operation is completed may limit or prevent the running of new gas generating units or other well tools past the sanded off apertures. The sand cake buildup can, however, be minimized utilizing relatively thin plate-like materials such as mica, which may provide a relatively thin sand cake wall and a very low permeability seal over the perforations without creating a significant physical obstacle in the wellbore.

Since the fracturing operation in accordance with the present invention occurs over a relatively short time interval of from 5 to 10 seconds, the instrument unit 40 and the lower end of the wireline 28 are exposed to high temperatures of the combustion gasses for very short periods of time (about 0.25 to 0.50 seconds) which should not create any damage to either the instrument unit or the wireline itself. However, if temperature caused damage cannot be kept negligible, igniter cord can be used to connect the instrument unit 40 to the top of the generating unit 42 and such cord may be a few hundred feet in length to thereby keep the wireline and the instrument unit from being exposed to combustion gasses.

An estimated time schedule for a decompression type fracturing operation according to the above described system and method contemplates that from the commencement of run-in of one set of generating units 42 and 44 to the retrieval of the wireline 28 and the injection of a second set of gas generating units past the blowout preventer 22 should not require more than about one hour. Total time is broken down into twenty minutes for wireline run-in with a first set of generating units 42 and 44, followed by positioning operations to place the shaped charges 66 of the unit 44 at the target position over about a ten minute interval, followed by ignition and stimulation consuming less than a tenth of a minute, and then retrieval of the wireline with the instrument unit 40 only requiring about ten minutes. Twenty minutes is then required for insertion of a second set of generating units 42 and 44.

Assuming that a fluid decompression fracturing operation can be accomplished in about one hour per zone, then 15 to 20 zones can be independently stimulated per day. The actual fluid pumping time per zone will be about ten minutes or about five to seven hours of total pumping time per well per day with each zone being injected with about 15,000 pounds of sand propant. One of the major advantages of the fracturing method and system of the present invention is that it is not necessary to employ standby pumping equipment since the pumping equipment is used only to recharge the wellbore between fracturing operations.

The foregoing detailed description of a fluid decompression type formation fracturing operation is intended to be primarily exemplary only. The process may be carried out in wells drilled offshore as well as onshore. The actual volumes of material and times required will vary somewhat with the diameter of the well casing, the overall depth of the well and the location of the zone being fractured. Although the provision of two gas generating units separated vertically in the wellbore, as indicated for the example given, is believed to provide a superior fracturing operation it is contemplated that the basic fluid decompression process may be carried out utilizing a single gas generating unit equipped with shaped perforating charges, or the location of a third gas generating unit above the unit 42, for example or below the unit 44. The provision of a third gas generating unit will, of course, affect the flow characteristics and the total perforation flow area required.

The present invention contemplates that the location of the gas generating unit may also be spaced from the location of a perforating device although the location of a gas generating unit directly surrounding the casing perforating apparatus assures the initial flow of high pressure sand-free gas into the formation to initiate the fracturing process in a superior manner. Those skilled in the art will also recognize various other substitutions and modifications with respect to the system and process described herein and which may be employed without departing from the scope and spirit of the invention recited in the appended claims.

What I claim is:

1. In a system for fracturing a subterranean earth formation to stimulate the production of fluids from said formation into a wellbore extending to said formation, perforating and gas generating means for forming apertures for the flow of fluid between said wellbore and said formation and for generating combustion gases to initiate fractures in said formation comprising:

elongated generally cylindrical canister means adapted to be disposed in said wellbore; said canister means including a first section including a plurality of explosive perforating charges for forming said apertures and a plurality of second sections connected end to end to said first section with each second section including a quantity of combustible propellant material for producing a predetermined quantity of combustion gas and being formed in a first annular ring of relatively fast burn material and a cylindrical core portion within said ring comprising slower burning material, said second sections being disposed in a generally cylindrical outer canister member formed of a material which will disintegrate to a state which will preclude plugging said apertures upon ignition and burning of said propellant material, fuse means for igniting said fast burn material, coupling means for connecting said plurality of second sections and said first section to each other prior to insertion of said perforating and gas generating means into said wellbore, and means for suspending said perforating and gas generating means in said wellbore.

2. The invention set forth in claim 1 wherein:

said fuse means comprise elongated fuse cords extending through said second sections and from at least one end thereof, respectively, for insertion in the combustible material of an adjacent section upon assembly of one section to another.

3. The invention set forth in claim 1 wherein:

said canister member comprises a material of sufficient flexibility to transmit wellbore pressures through said canister member to said combustible material.

* * * * *